US010948935B2

(12) United States Patent
Yasusaka et al.

(10) Patent No.: US 10,948,935 B2
(45) Date of Patent: Mar. 16, 2021

(54) LINEAR REGULATOR AND SEMICONDUCTOR INTEGRATED CIRCUIT

(71) Applicant: ROHM Co., LTD., Kyoto (JP)

(72) Inventors: Makoto Yasusaka, Kyoto (JP); Kotaro Iwata, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/929,314

(22) Filed: Apr. 24, 2020

(65) Prior Publication Data

US 2020/0341499 A1 Oct. 29, 2020

(30) Foreign Application Priority Data

Apr. 26, 2019 (JP) ..... JP2019-086510

(51) Int. Cl.
*G05F 1/575* (2006.01)
*G05F 1/569* (2006.01)

(52) U.S. Cl.
CPC ..... *G05F 1/575* (2013.01); *G05F 1/569* (2013.01)

(58) Field of Classification Search
None
See application file for complete search history.

(56) References Cited

U.S. PATENT DOCUMENTS 6,917,190 B2 * 7/2005 Matsuo ..... G05F 1/56 323/287
7,064,533 B2 * 6/2006 Hsu ..... G05F 1/575 323/282
8,564,264 B2 * 10/2013 Hallak ..... G05F 1/569 323/282
10,566,902 B1 * 2/2020 Romeo ..... G05F 3/242

FOREIGN PATENT DOCUMENTS

JP 2001100851 A 4/2001

* cited by examiner

*Primary Examiner* — Jeffery S Zweizig
(74) *Attorney, Agent, or Firm* — Chip Law Group

(57) ABSTRACT

Disclosed is a linear regulator for generating an output voltage from an input voltage with reference to a ground potential, the linear regulator including a semiconductor integrated circuit, and an external diode that is externally connected to the semiconductor integrated circuit, in which the semiconductor integrated circuit includes an input terminal, an output terminal, an output transistor, a parallel diode, and a control circuit, and an anode of the external diode is connected to a ground, and a cathode of the external diode is connected to the output terminal.

14 Claims, 7 Drawing Sheets

LINEAR REGULATOR AND SEMICONDUCTOR INTEGRATED CIRCUIT

The present disclosure contains subject matter related to that disclosed in Japanese Priority Patent Application JP 2019-086510 filed in the Japan Patent Office on Apr. 26, 2019, the entire content of which is hereby incorporated by reference.

BACKGROUND

The present disclosure relates to a linear regulator and a semiconductor integrated circuit.

FIG. 12 illustrates a schematic configuration of a linear regulator 900 according to a reference configuration (refer to Japanese Patent Laid-open No. 2001-100851). The linear regulator 900 depicted in FIG. 12 includes a power supply integrated circuit (IC) 910 and a Zener diode for surge protection 920 (hereinafter may be abbreviated to the Zener diode 920). The power supply IC 910 includes an input terminal 911 and an output terminal 912, and generates an output voltage Vo by decreasing an input voltage Vi applied to the input terminal 911. The output voltage Vo is outputted from the output terminal 912. The input voltage Vi and the output voltage Vo each have a positive direct current (DC) voltage value. In the Zener diode 920, the anode is connected to a ground having a ground potential of 0 V, and the cathode is connected to the input terminal 911 through a wiring 930.

The input voltage Vi is supplied from an undepicted voltage source to the input terminal 911 through the wiring 930. It is presumable that a supply voltage from the voltage source is within a certain range. However, a surge voltage outside the certain range might be applied to the input terminal 911. In order to prevent a positive surge voltage higher than a maximum rated voltage of the input terminal 911 from being applied to the input terminal 911 in the power supply IC 910, the Zener diode 920 having a Zener voltage Vz not higher than the maximum rated voltage is included.

More specifically, when a positive surge voltage is applied to the input terminal 911 in the linear regulator 900, a surge current based on the positive surge voltage flows from the cathode of the Zener diode 920 to the anode as depicted in FIG. 13A so that a positive voltage applied to the input terminal 911 is clamped to the Zener voltage Vz. This protects the power supply IC 910 from the positive surge voltage.

Further, a negative surge voltage might be applied to the input terminal 911. In such an instance, a surge current based on the negative surge voltage flows from the anode of the Zener diode 920 to the cathode as depicted in FIG. 13B so that the magnitude of a negative voltage applied to the input terminal 911 is clamped to a forward voltage (Vf) of the Zener diode 920. This reduces the influence of the negative surge voltage on the power supply IC 910 and a circuit (not depicted) in the output stage of the power supply IC 910.

SUMMARY

However, in a case where the input voltage Vi is high, the configuration depicted in FIG. 12 causes an increased loss in the Zener diode 920 when a positive surge voltage is generated. This makes it necessary to use a Zener diode having a large package size as the Zener diode 920 (this will be described in detail later). However, the Zener diode 920 having a large package size should not be used because it increases the overall size of the linear regulator 900 and entails an increased cost.

The present disclosure has been made in view of the above circumstances, and provides a linear regulator and a semiconductor integrated circuit that will contribute to reducing a circuit size or cost.

According to a first aspect of the present disclosure, there is provided a linear regulator that includes a semiconductor integrated circuit and an external diode externally connected to the semiconductor integrated circuit, and generates an output voltage from an input voltage with reference to a ground potential. The semiconductor integrated circuit includes an input terminal, an output terminal, an output transistor, a parallel diode, and a control circuit. The input voltage is applied to the input terminal. The output voltage is applied to the output terminal. The output transistor is disposed between the input terminal and the output terminal. The parallel diode is formed in parallel to the output transistor, and has a forward direction from the output terminal to the input terminal. The control circuit controls the output transistor in accordance with a feedback voltage based on the output voltage. An anode of the external diode is connected to a ground having the ground potential. A cathode of the external diode is connected to the output terminal.

According to a second aspect of the present disclosure, there is provided the linear regulator as described in the first aspect, in which the semiconductor integrated circuit includes an output protection diode section disposed between the output terminal and the ground. The output protection diode section includes one or more output protection diodes having a forward direction from the ground to the output terminal. Forward voltage of the output protection diode section is higher than the forward voltage of the external diode.

According to a third aspect of the present disclosure, there is provided the linear regulator as described in the first aspect, in which the semiconductor integrated circuit includes the output protection diode section disposed between the output terminal and the ground. The output protection diode section includes a first output protection diode and a second output protection diode. The cathodes of the first and second output protection diodes are respectively connected to the output terminal and the ground. The anodes of the first and second output protection diodes are commonly connected to each other.

According to a fourth aspect of the present disclosure, there is provided the linear regulator as described in any one of the first to third aspects, in which the semiconductor integrated circuit includes an input protection diode section disposed between the input terminal and the ground. The input protection diode section includes one or more input protection diodes having a forward direction from the ground to the input terminal. The forward voltage of the input protection diode section is higher than the voltage sum of the forward voltage of the external diode and the forward voltage of the parallel diode.

According to a fifth aspect of the present disclosure, there is provided the linear regulator as described in any one of the first to third aspects, in which the semiconductor integrated circuit includes the input protection diode section disposed between the input terminal and the ground. The input protection diode section includes a first input protection diode and a second input protection diode. The cathodes of the first and second input protection diodes are respectively connected to the input terminal and the ground. The anodes of the first and second input protection diodes are commonly connected to each other.

According to a sixth aspect of the present disclosure, there is provided the linear regulator as described in any one of the first to fifth aspects, in which the parallel diode is a parasitic diode formed on a metal-oxide-semiconductor field-effect transistor (MOSFET) that acts as the output transistor.

According to a seventh aspect of the present disclosure, there is provided the linear regulator as described in any one of the first to sixth aspects, in which, when a negative surge voltage is applied to the input terminal, a current based on the negative surge voltage flows from the ground toward the input terminal through the external diode, the output terminal, and the parallel diode.

According to an eighth aspect of the present disclosure, there is provided a semiconductor integrated circuit included in a linear regulator that generates an output voltage from an input voltage with reference to a ground potential. The semiconductor integrated circuit includes an input terminal, an output terminal, an output transistor, a parallel diode, and a control circuit. The input voltage is applied to the input terminal. The output voltage is applied to the output terminal. The output terminal is to be connected to the cathode of an external diode disposed outside the semiconductor integrated circuit. The output transistor is disposed between the input terminal and the output terminal. The parallel diode is formed in parallel to the output transistor, and has a forward direction from the output terminal to the input terminal. The control circuit controls the output transistor in accordance with a feedback voltage based on the output voltage. The anode of the external diode is connected to a ground having the ground potential.

According to a ninth aspect of the present disclosure, there is provided the semiconductor integrated circuit as described in the eighth aspect, in which the semiconductor integrated circuit includes an output protection diode section disposed between the output terminal and the ground. The output protection diode section includes one or more output protection diodes having the forward direction from the ground to the output terminal. The forward voltage of the output protection diode section is higher than the forward voltage of the external diode.

According to a tenth aspect of the present disclosure, there is provided the semiconductor integrated circuit as described in the eighth aspect, in which the semiconductor integrated circuit includes an output protection diode section disposed between the output terminal and the ground. The output protection diode section includes the first output protection diode and the second output protection diode. The cathodes of the first and second output protection diodes are respectively connected to the output terminal and the ground. The anodes of the first and second output protection diodes are commonly connected to each other.

According to an eleventh aspect of the present disclosure, there is provided the semiconductor integrated circuit as described in any one of the eighth to tenth aspects, in which the semiconductor integrated circuit includes an input protection diode section disposed between the input terminal and the ground. The input protection diode section includes one or more input protection diodes having the forward direction from the ground to the input terminal. The forward voltage of the input protection diode section is higher than the voltage sum of the forward voltage of the external diode and the forward voltage of the parallel diode.

According to a twelfth aspect of the present disclosure, there is provided the semiconductor integrated circuit as described in any one of the eighth to tenth aspects, in which the semiconductor integrated circuit includes an input protection diode section disposed between the input terminal and the ground. The input protection diode section includes the first input protection diode and the second input protection diode. The cathodes of the first and second input protection diodes are respectively connected to the input terminal and the ground. The anodes of the first and second input protection diodes are commonly connected to each other.

According to a thirteenth aspect of the present disclosure, there is provided the semiconductor integrated circuit as described in any one of the eighth to twelfth aspects, in which the parallel diode is the parasitic diode formed on the MOSFET that acts as the output transistor.

According to a fourteenth aspect of the present disclosure, there is provided the semiconductor integrated circuit as described in any one of the eighth to thirteenth aspects, in which, when the negative surge voltage is applied to the input terminal, the current based on the negative surge voltage flows from the ground toward the input terminal through the external diode, the output terminal, and the parallel diode.

According to the above-mentioned aspects of the present disclosure, it is possible to provide a linear regulator and a semiconductor integrated circuit that will contribute to reducing a circuit size or cost.

DETAILED DESCRIPTION OF THE PREFERRED EMBODIMENTS

Figure 1:
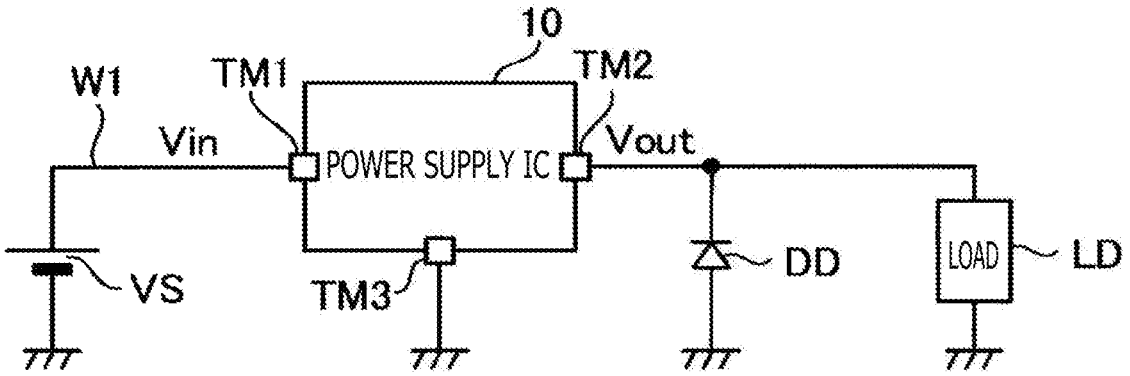
FIG. 1 is a diagram illustrating an overall configuration of a linear regulator according to a first embodiment of the present disclosure.

Example embodiments of the present disclosure will now be described in detail with reference to the accompanying drawings. In the drawings referenced below, like elements are designated by like reference numeral and, in principle, will not be redundantly described. In this document, for the purpose of simplification of description, by denoting information, signals, physical quantities, members, parts, and the like with reference symbols or marks, the names of information, signals, physical quantities, members, parts, and the like corresponding to the symbols or marks may be omitted or abbreviated. For example, a later-described output protection diode section referred to by "20" (see FIG. 6) may be designated as an output protection diode section 20 or abbreviated as a diode section 20. However, they all denote the same thing.

First of all, several terms used in the description of the embodiments of the present disclosure will be described. In the embodiments of the present disclosure, the term "IC" is an abbreviation of an integrated circuit. The term "ground" denotes a conductive part having a potential of 0 V (zero volt), which is a reference voltage or denotes a potential of 0 V itself. A potential of 0 V may be referred to as a ground potential. In the embodiments of the present disclosure, a voltage indicated without referring to a specific reference is a potential with respect to the ground. As regards a transistor configured as a field-effect transistor (FET) including a MOSFET, the term "ON state" denotes a state where there is conduction between the drain and source of the transistor, and the term "OFF state" denotes a cut-off state where there is no conduction between the drain and source of the transistor. This also holds true for transistors not classified as a FET. The ON state and the OFF state may be hereinafter simply referred to as ON and OFF, respectively. The term "MOSFET" is an acronym for metal-oxide-semiconductor field-effect transistor.

First Embodiment

A first embodiment of the present disclosure will now be described. FIG. 1 is a diagram illustrating a schematic configuration of a linear regulator that is a power supply device according to the first embodiment of the present disclosure. The linear regulator according to the present embodiment includes a power supply IC 10 and an external diode DD. The power supply IC 10 includes a semiconductor integrated circuit for configuring the linear regulator. The external diode DD is externally connected to the power supply IC 10. A voltage source VS is connected to an input side of the linear regulator. A load LD is connected to an output side of the linear regulator. The linear regulator according to the present embodiment may be a power supply device classified as a low-dropout (LDO) regulator or a power supply device not classified as an LDO regulator.

Figure 2:
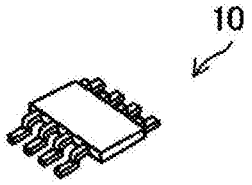
FIG. 2 is an external perspective view of a power supply IC according to the first embodiment of the present disclosure.

As depicted in FIG. 2, the power supply IC 10 is an electronic part that is formed by enclosing a semiconductor integrated circuit in a resin-formed housing (package). A plurality of exposed external terminals are disposed on the power supply IC 10. Such external terminals include an input terminal TM1, an output terminal TM2, and a ground terminal TM3 as depicted in FIG. 1. The external terminals may additionally include terminals other than the above-mentioned ones. The number of external terminals of the power supply IC 10 and its external appearance depicted in FIG. 2 are merely illustrative and not restrictive, and may be set as desired.

An input voltage Vin having a predetermined positive DC voltage value is applied to the input terminal TM1. The input voltage Vin is supplied from the voltage source VS, such as a battery, to the input terminal TM1 through a wiring W1. The wiring W1 is disposed outside the power IC 10 and used to connect the voltage source VS to the input terminal TM1. The power supply IC 10 generates an output voltage Vout by decreasing the input voltage Vin applied to the input terminal TM1. The output voltage Vout is applied to the output terminal TM2. Except for a transient state, the output voltage Vout has a predetermined positive DC voltage value. The ground terminal TM3 is connected to a ground having a ground potential. The input voltage Vin and the output voltage Vout are voltages with respect to the ground potential. The output voltage Vout is lower than the input voltage Vin. In some cases, however, the output voltage Vout may be substantially equal to the input voltage Vin. The output voltage Vout is supplied to the load LD connected to the output terminal TM2. The output voltage Vout is used as a power supply voltage for driving the load LD. The load LD may be any load that is driven by a DC voltage.

The external diode DD is disposed outside the power supply IC 10. The cathode of the external diode DD is connected to the output terminal TM2 of the power supply IC 10. The anode of the external diode DD is connected to the ground.

In some cases, a positive surge voltage (e.g., 100 V) having a potential higher than the voltage (e.g., 40 V) to be outputted from the voltage source VS may be applied to the input terminal TM1 (i.e., applied to the wiring W1). The linear regulator according to the present embodiment does not include a Zener diode corresponding to the Zener diode 920 depicted in FIG. 12, that is, a Zener diode for surge protection that can be disposed outside the power supply IC 10 and is to be connected between the input terminal TM1 and the ground.

This point is addressed by configuring the power IC 10 to increase the maximum rated voltage of the input terminal TM1. More specifically, the input terminal TM1 has a maximum rated voltage higher than a positive surge voltage that may be applied to the input terminal TM1. Therefore, even when a positive surge voltage is applied to the input terminal TM1, a surge current based on the positive surge voltage does not substantially flow through the input terminal TM1. Consequently, the power supply IC 10 and a circuit (including the load LD) in the output stage of the power supply IC 10 will not be significantly affected. The technology for increasing the maximum rated voltage of the input terminal TM1 is not described here because it is well known.

In some cases, however, a negative surge voltage may be applied to the input terminal TM1 (i.e., applied to the wiring W1). The external diode DD effectively functions to protect against the negative surge voltage. This matter will be described later.

The first embodiment includes the following example embodiments EX1_1 to EX1_4. The matters described above in conjunction with the first embodiment are applied to the example embodiments EX1_1 to EX1_4 unless specifically stated otherwise and as long as there is no contradiction. In a case where the matters described in conjunction with the individual example embodiments are contradictory to those described in conjunction with the first embodiment, the matters described in conjunction with the individual example embodiments may take precedence. Further, as long as there is no contradiction, the matters described in conjunction with one of the example embodiments EX1_1 to EX1_4 may be applied to another example embodiment (i.e., two or more of a plurality of the example embodiments may be combined).

Example Embodiment EX1_1

Figure 3:
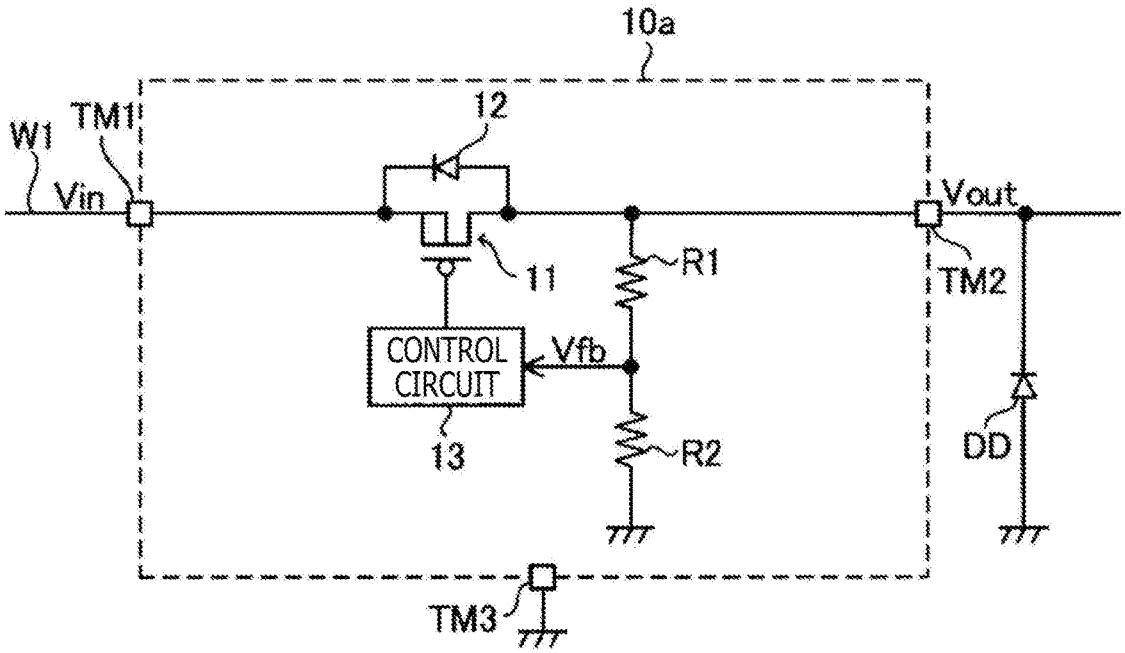
FIG. 3 is a diagram illustrating an internal configuration of the power supply IC according to an example embodiment EX1_1 of the first embodiment of the present disclosure.

The example embodiment EX1_1 will now be described. FIG. 3 illustrates an internal configuration of a power supply IC 10*a*, that is, the power supply IC 10 according to the example embodiment EX1_1. The power supply IC 10*a* includes an output transistor 11, a parallel diode 12, a control circuit 13, and a voltage divider circuit. The voltage divider circuit includes voltage-dividing resistors R1 and R2.

The output transistor 11 is disposed between the input terminal TM1 and the output terminal TM2. Therefore, a current flowing from the output terminal TM2 toward the load LD flows through the output transistor 11. In the power supply IC 10*a*, the output transistor 11 is configured as a P-channel MOSFET, the source of the output transistor 11 is connected to the input terminal TM1, and the drain of the output transistor 11 is connected to the output terminal TM2.

The parallel diode 12 is formed in parallel to the output transistor 11, and has a forward direction from the output terminal TM2 to the input terminal TM1. Therefore, the anode of the parallel diode 12 is connected to the output terminal TM2, and the cathode of the parallel diode 12 is connected to the input terminal TM1. The parallel diode 12 is a parasitic diode formed on a MOSFET that acts as the output transistor 11. Accordingly, the parallel diode 12 may be hereinafter referred to as the parasitic diode 12.

The voltage divider circuit, which includes the voltage-dividing resistors R1 and R2, is disposed between the output terminal TM2 and the ground, and used to generate a feedback voltage Vfb based on the output voltage Vout. More specifically, the voltage-dividing resistor R1 is connected at one end to the output terminal TM2, and connected at the other end to the ground through the voltage-dividing resistor R2. As a voltage proportional to the output voltage Vout, the feedback voltage Vfb is generated at a connection node between the voltage-dividing resistors R1 and R2. The feedback voltage Vfb is transmitted to the control circuit 13.

The control circuit 13 controls the gate voltage of the output transistor 11 in such a manner that the feedback voltage Vfb agrees with a predetermined reference voltage. As a result, a voltage determined by the reference voltage and the resistance value ratio between the resistors R1 and R2 is set as a target voltage Vtg. Accordingly, the control circuit 13 continuously controls the ON resistance value of the output transistor 11 in such a manner that the output voltage Vout agrees with the target voltage Vtg.

The output voltage Vout itself may be the feedback voltage Vfb. In any case, the feedback voltage Vfb is a voltage based on the output voltage Vout. Further, the voltage-dividing resistors R1 and R2 may be disposed outside the power supply IC 10*a*. In such an instance, a feedback terminal for receiving the feedback voltage Vfb generated by the voltage-dividing resistors R1 and R2 is disposed as an external terminal of the power supply IC 10*a*.

Figure 12:
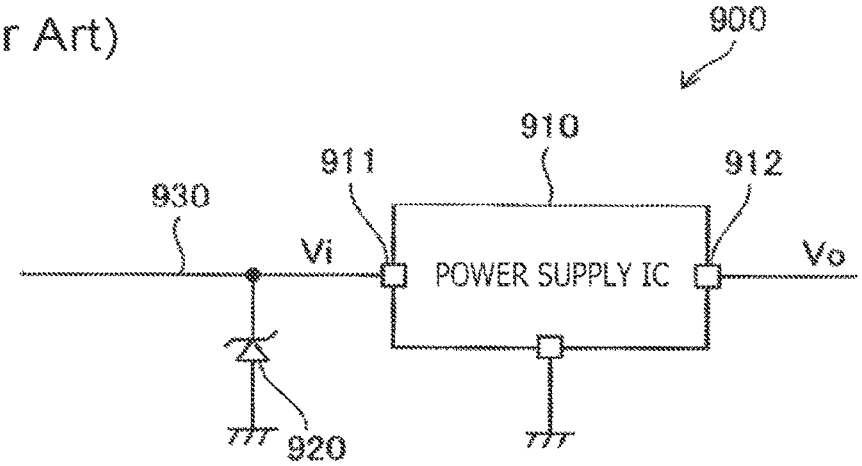
FIG. 12 (Prior Art)
FIG. 12 is a diagram illustrating an overall configuration of a linear regulator according to the reference configuration.

As described above, a Zener diode for surge protection corresponding to the Zener diode 920 depicted in FIG. 12 is not connected to the input terminal TM1 of the power supply IC 10*a*. However, no problem occurs because the input terminal TM1 has a maximum rated voltage higher than a positive surge voltage that may be applied to the input terminal TM1.

However, if a negative surge voltage is applied to the input terminal TM1 in a state where no Zener diode is provided for the input terminal TM1, a negative voltage is generated at the output terminal TM2 by way of the parasitic diode 12 of the output transistor 11. If, in such an instance, no appropriate measures are taken, a high negative voltage is applied to a circuit (including the load LD) in the output stage of the power supply IC 10*a*. Consequently, the circuit in the output stage of the power supply IC 10*a* may be damaged.

In view of the above circumstances, the linear regulator according to the present embodiment is configured such that a diode for protecting against a negative surge voltage is connected to the output terminal TM2 as the external diode DD.

Figure 4:
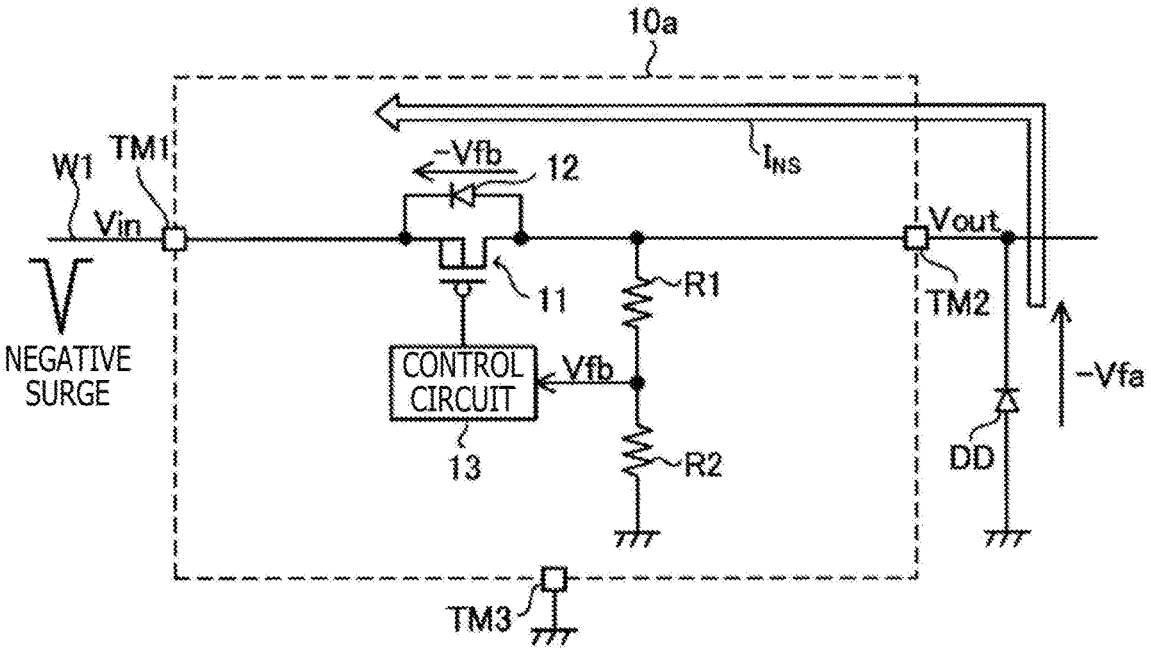
FIG. 4 is a diagram illustrating a state where a negative surge voltage is applied in accordance with the example embodiment EX1_1 of the first embodiment of the present disclosure.

FIG. 4 illustrates the flow of a surge current (hereinafter referred to as the surge current INS) that is generated when a negative surge voltage is applied to the input terminal TM1. Referring to FIG. 4, "Vfa" represents the forward voltage of the external diode DD in a case where the surge current INS flows to the external diode DD, and "Vfb" represents the forward voltage of the parasitic diode 12 in a case where the surge current INS flows to the parasitic diode 12. When a negative surge voltage is applied to the input terminal TM1, the surge current INS based on the negative surge voltage flows from the ground toward the input terminal TM1 through the external diode DD, the output terminal TM2, and the parasitic diode 12. In this instance, the magnitude of a negative voltage generated at the output terminal TM2 is clamped to the forward voltage of the external diode DD.

Consequently, no high negative voltage will be applied to the circuit (including the load LD) in the output stage of the power supply IC 10*a*. This not only prevents the circuit in the output stage of the power supply IC 10*a* from being damaged due to a negative surge voltage, but also beneficially works to protect the power supply IC 10*a* itself. Further, the external diode DD may not need to protect against the application of a positive surge voltage. This significantly reduces the loss that may occur in the external diode DD. Therefore, a diode in a small package can be used as the external diode DD. This makes it possible to reduce the overall size and cost of the linear regulator.

Figure 5:
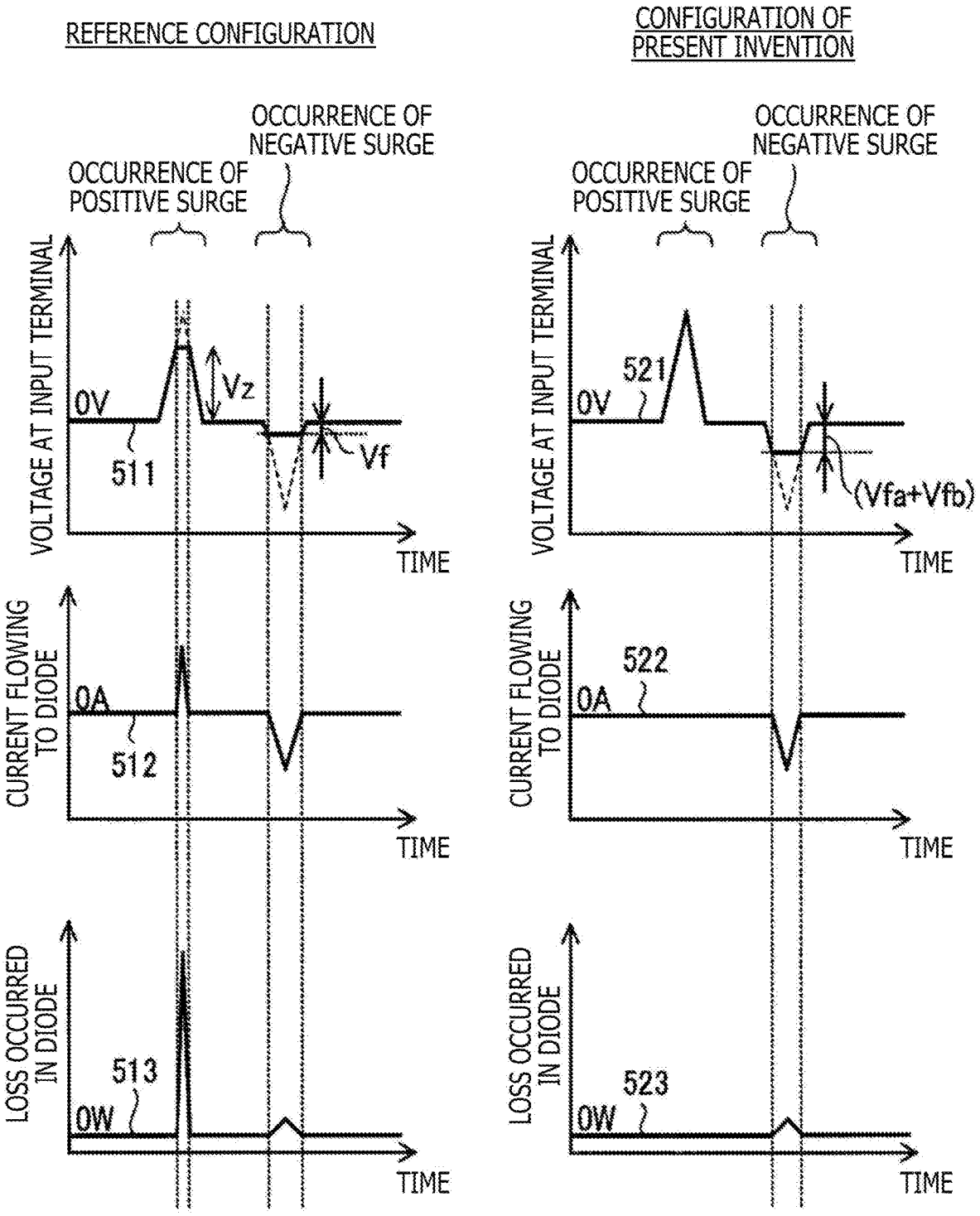
FIG. 5 is a diagram illustrating the comparison of voltage, current, and loss upon the occurrence of a surge between a reference configuration and a configuration according to the first embodiment of the present disclosure.

Referring to FIG. 5, incurred loss will now be compared between a configuration depicted in FIG. 12 (a reference configuration) and a configuration depicted in FIG. 3 in accordance with the present embodiment of the present disclosure. FIG. 5 depicts various waveforms 511-513 and 521-523 that are generated when a positive surge voltage and a negative surge voltage are applied to input terminals (911, TM1) at different time points in a state where the voltage at the input terminals (911, TM1) is 0 V. More specifically, the waveform 511 is a voltage waveform of the input terminal 911 in the reference configuration depicted in FIG. 12. The waveform 512 is the waveform of a current flowing to the Zener diode 920 in the reference configuration depicted in FIG. 12. The waveform 513 is the waveform of a loss incurred in the Zener diode 920 in the reference configuration depicted in FIG. 12. The waveform 521 is a voltage waveform of the input terminal TM1 in the configuration depicted in FIG. 3. The waveform 522 is the waveform of a current flowing to the external diode DD in the configuration depicted in FIG. 3. The waveform 523 is the waveform of a loss incurred in the external diode DD in the configuration depicted in FIG. 3. Although numerical values are merely examples, the positive or negative surge voltage is presumably a pulse voltage that has a crest value of 100 V in magnitude (absolute value) and a width of approximately 10 milliseconds.

Figure 13A:
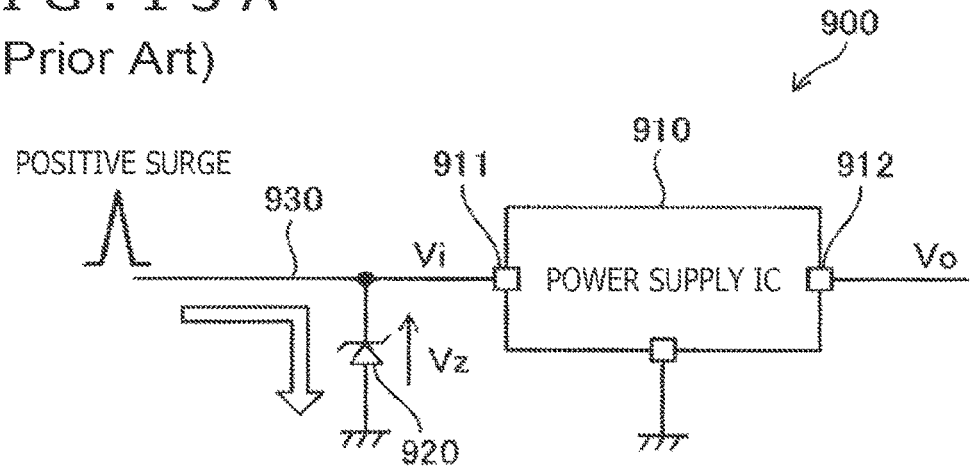
FIG. 13A (Prior Art)
FIGS. 13A and 13B are diagrams illustrating states where positive and negative surge voltages are generated at an input terminal of the linear regulator according to the reference configuration.
Figure 13B:
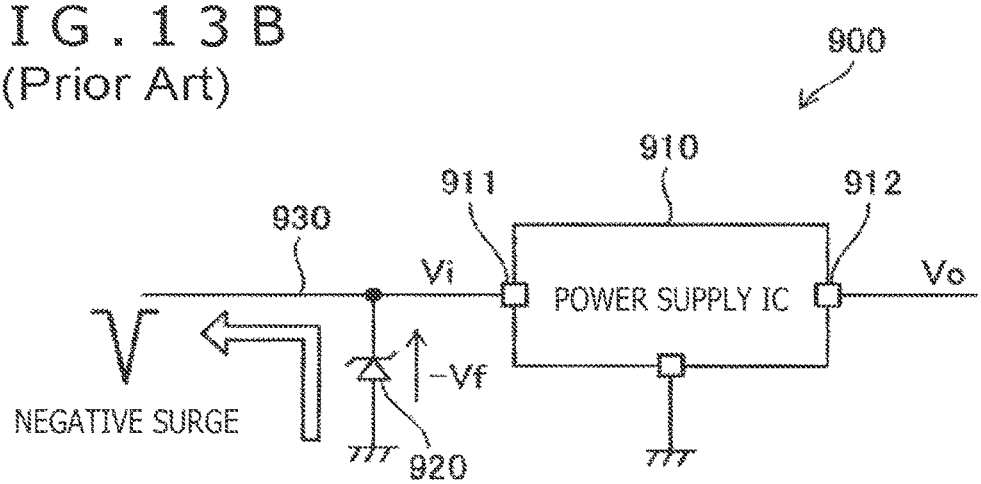
FIG. 13B (Prior Art)

In the reference configuration depicted in FIG. 12, the Zener voltage Vz of the Zener diode 920 may need to be higher than the input voltage Vi. Therefore, when a positive surge voltage is applied to the input terminal 911, the loss (proportional to Vz) incurred in the Zener diode 920 is correspondingly high. Consequently, a high-cost Zener diode having a large package size may need to be used as the Zener diode 920. When a negative surge voltage is applied to the input terminal 911, the loss incurred in the Zener diode 920 is relatively small because only a forward voltage Vf (see FIG. 13B as well) is generated in the Zener diode 920 itself (see the waveform 513).

Meanwhile, in the configuration depicted in FIG. 3, the maximum rated voltage of the power supply IC 10*a* itself is increased. Therefore, no surge current is generated upon the application of a positive surge voltage. Consequently, the external diode DD suffers no loss when a positive surge voltage is applied. When a negative surge voltage is applied to the input terminal TM1, a current flows to the external diode DD. However, only the forward voltage Vfa (see FIG. 4 as well) is generated in the external diode DD itself. Therefore, the loss incurred in the external diode DD is relatively small (see the waveform 523) and substantially equal to the loss incurred in the reference configuration depicted in FIG. 12. This makes it possible to reduce the size of the external diode DD.

In the configuration depicted in FIG. 3, the surge current INS (see FIG. 4) based on a negative surge voltage flows to the parasitic diode 12 as well. However, the output transistor has a sufficiently large transistor size because it is configured as a power transistor for supplying electrical power to the load LD. Therefore, the current carrying capacity (allowable forward current value) of the parasitic diode 12 is correspondingly high. That is, no problem occurs even if the surge current INS flows to the parasitic diode 12.

Further, the external diode DD may be of any type. For example, the external diode DD may be a rectifier diode (PN diode) based on PN junction, a Schottky barrier diode, or a Zener diode. However, the reverse bias breakdown voltage of the external diode DD may need to be higher than the target voltage Vtg of the output voltage Vout. That is, even when the target voltage Vtg of the output voltage Vout (in reality, a voltage higher than the target voltage Vtg by a predetermined margin voltage) is applied to the cathode of the external diode DD, it is necessary that no current flow to the external diode DD. Moreover, the allowable forward current value of the external diode DD may need to be equal to or greater than the value of the surge current INS (see FIG. 4) that is presumably generated.

Example Embodiment EX1_2

Figure 6:
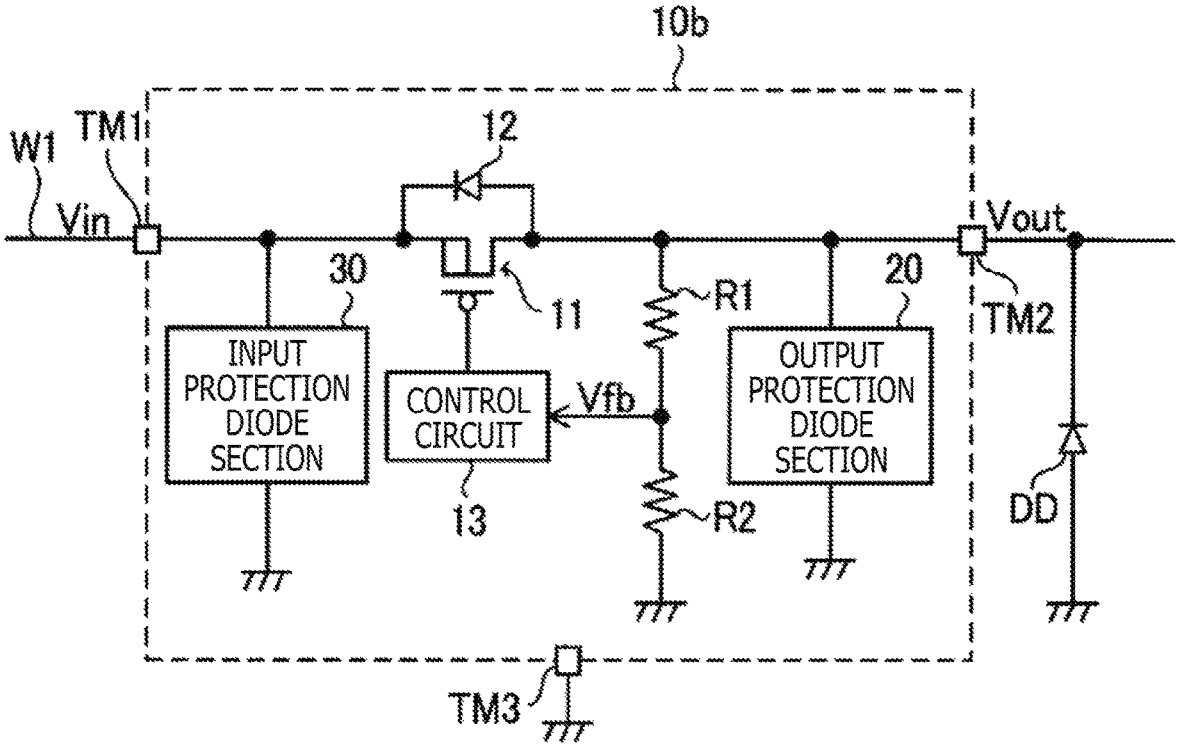
FIG. 6 is a diagram illustrating an internal configuration of the power supply IC according to an example embodiment EX1_2 of the first embodiment of the present disclosure.

The example embodiment EX1_2 will now be described. An electrostatic discharge (ESD) protection element may be disposed in the power supply IC 10 depicted in FIG. 1. FIG. 6 is a diagram illustrating an internal configuration of a power supply IC 10*b*, that is, the power supply IC 10 according to the example embodiment EX1_2. The power supply IC 10*b* depicted in FIG. 6 is formed by adding an output protection diode section 20 and an input protection diode section 30 to the power supply IC 10*a* (see FIG. 3) according to the example embodiment EX1_1. Except for such additions, the power supply IC 10*b* depicted in FIG. 6 is configured the same as the power supply IC 10*a* depicted in FIG. 3. Either one of the diode sections 20 and 30 in the power supply IC 10*b* may be deleted. However, the following description is given on the assumption that the diode sections 20 and 30 are both included in the power supply IC 10*b*.

First of all, the output protection diode section 20 will be described. The output protection diode section 20 is an ESD protection element for protecting the power supply IC 10*b* or its peripheral circuits against static electricity that may be applied to the output terminal TM2. The output protection diode section 20 is formed inside the power supply IC 10*b* and disposed between the output terminal TM2 and the ground.

Figure 7A:
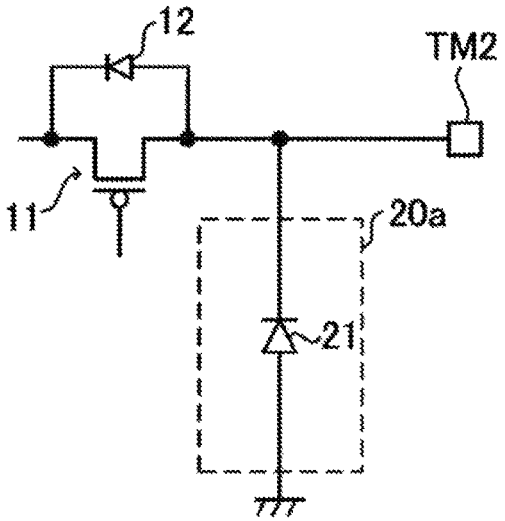
FIGS. 7A and 7B are diagrams illustrating first and second example configurations of an output protection diode section according to the example embodiment EX1_2 of the first embodiment of the present disclosure.
Figure 7B:
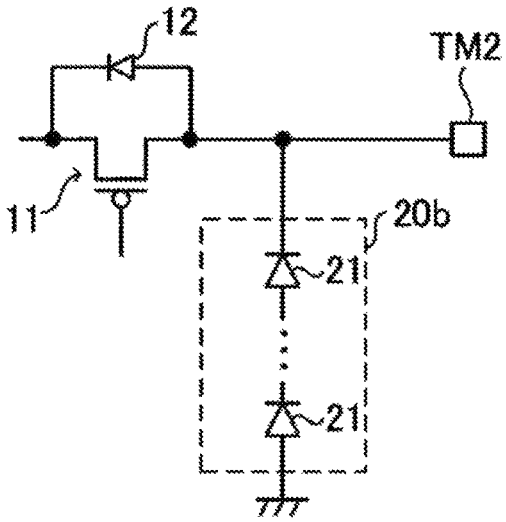

FIG. 7A depicts an output protection diode section 20*a* representative of a first example configuration of the output protection diode section 20. FIG. 7B depicts an output protection diode section 20*b* representative of a second example configuration of the output protection diode section 20. In the first or second example configuration of the output protection diode section 20, the output protection diode section 20 includes one or more output protection diodes 21 having a forward direction from the ground to the output terminal TM2.

More specifically, the output protection diode section 20*a* depicted in FIG. 7A includes a single output protection diode 21. In the diode section 20*a*, the anode and cathode of the output protection diode 21 are respectively connected to the ground and the output terminal TM2.

Meanwhile, the output protection diode section 20*b* depicted in FIG. 7B includes a series circuit that includes the first to mth output protection diodes 21 (m is an integer of 2 or greater). In the diode section 20*b*, the anode of the first output protection diode 21 is connected to the ground, the cathode of the mth output protection diode 21 is connected to the output terminal TM2, and the cathode of the ith output protection diode 21 is connected to the anode of the (i+1)th output protection diode 21 ("i" is an integer of 1 or greater but smaller than m).

When a negative surge voltage is applied to the input terminal TM1 (see FIG. 4), a negative voltage (−Vfa) having the same magnitude as the forward voltage Vfa of the external diode DD is applied to the output terminal TM2. Therefore, if the forward voltage of the output protection diode section 20 (20*a*, 20*b*) is lower than the forward voltage Vfa of the external diode DD, a large current may flow to the diode section 20 upon the application of a negative surge voltage, and damage the diode section 20.

Consequently, in the first or second example configuration of the output protection diode section 20, the forward voltage of the output protection diode section 20 is set to be higher than the forward voltage Vfa of the external diode DD. This prevents the surge current INS from flowing to the output protection diode section 20 upon the application of a negative surge voltage to the input terminal TM1. As a result, no problem occurs. More specifically, the forward voltage of the output protection diode section 20 in a case where a forward current having a predetermined current value flows to the output protection diode section 20 is set to be higher than the forward voltage Vfa of the external diode DD in a case where the forward current having the predetermined current value flows to the external diode DD. In this instance, the predetermined current value may be, for example, the current value of the surge current INS that is presumably generated based on the negative surge voltage.

In the output protection diode section 20*a* depicted in FIG. 7A, the forward voltage of the output protection diode section 20 represents the forward voltage of the single output protection diode 21. In the output protection diode section 20*b* depicted in FIG. 7B, the forward voltage of the output protection diode section 20*b* represents the sum of forward voltages of the first to mth output protection diodes 21. When the output protection diode 21 and the external diode DD have the same characteristics concerning the forward voltage, "m 2" should be applied to the output protection diode section 20*b* depicted in FIG. 7B.

Depending on the current carrying capacity (allowable forward current value) of the output protection diode section 20, the forward voltage of the output protection diode section 20 may be substantially equal to the forward voltage Vfa of the external diode DD. In such a case, when a negative surge voltage is applied to the input terminal TM1, the surge current INS partly flows through the output protection diode section 20. However, the output protection diode section 20 does not become damaged or otherwise defective as far as such a current is tolerable by the output protection diode section 20.

Figure 8:
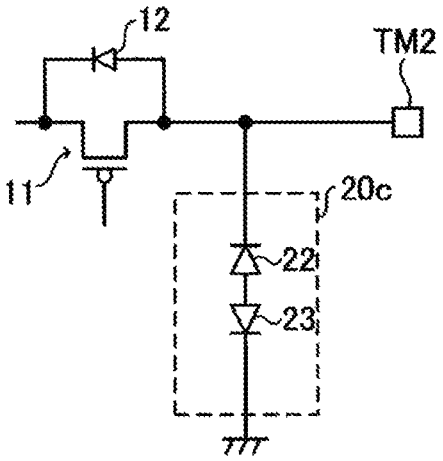
FIG. 8 is a diagram illustrating a third example configuration of the output protection diode section according to the example embodiment EX1_2 of the first embodiment of the present disclosure.

FIG. 8 illustrates an output protection diode section 20*c* representative of a third example configuration of the output protection diode section 20. The output protection diode section 20*c* includes output protection diodes 22 and 23. The anodes of these output protection diodes 22 and 23 are commonly connected to each other. The cathode of the output protection diode 22 is connected to the output terminal TM2, and the cathode of the output protection diode 23 is connected to the ground. Therefore, even if a negative voltage (−Vfa) based on the negative surge current INS is applied to the output terminal TM2, no problem occurs because no current flows to the output protection diode section 20*c*.

The input protection diode section 30 will now be described. The input protection diode section 30 is an ESD protection element for protecting the power supply IC 10*b* or its peripheral circuits against static electricity that may be applied to the input terminal TM1. The input protection diode section 30 is formed inside the power supply IC 10*b* and disposed between the input terminal TM1 and the ground.

Figure 9A:
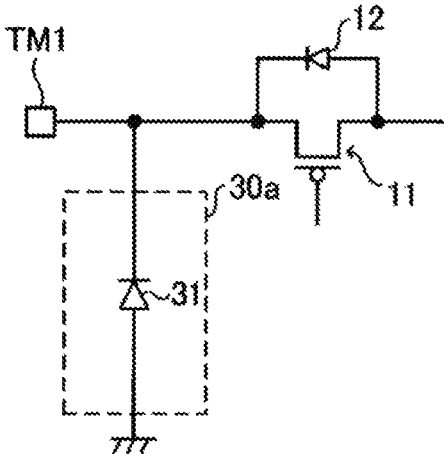
FIGS. 9A and 9B are diagrams illustrating first and second example configurations of an input protection diode section according to the example embodiment EX1_2 of the first embodiment of the present disclosure.
Figure 9B:
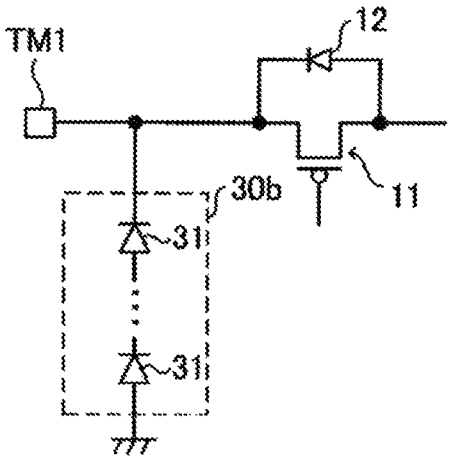

FIG. 9A depicts an input protection diode section 30*a* representative of a first example configuration of the input protection diode section 30. FIG. 9B depicts an input protection diode section 30*b* representative of a second example configuration of the input protection diode section 30. In the first or second example configuration of the input protection diode section 30, the input protection diode section 30 includes one or more input protection diodes 31 having a forward direction from the ground to the input terminal TM1.

More specifically, the input protection diode section 30*a* depicted in FIG. 9A includes a single input protection diode 31. In the diode section 30*a*, the anode and cathode of the input protection diode 31 are respectively connected to the ground and the input terminal TM1.

Meanwhile, the input protection diode section 30*b* depicted in FIG. 9B includes a series circuit that includes the first to nth input protection diodes 31 (n is an integer of 2 or greater). In the diode section 30*b*, the anode of the first input protection diode 31 is connected to the ground, the cathode of the nth input protection diode 31 is connected to the input terminal TM1, and the cathode of the ith input protection diode 31 is connected to the anode of the (i+1)th input protection diode 31 ("i" is an integer of 1 or greater but smaller than n).

When a negative surge voltage is applied to the input terminal TM1 (see FIG. 4), a negative voltage (−(Vfa+Vfb)) having the same magnitude as the sum (Vfa+Vfb) of the forward voltage Vfa of the external diode DD and the forward voltage Vfb of the parasitic diode 12 is applied to the input terminal TM1. Therefore, if the forward voltage of the input protection diode section 30 (30*a*, 30*b*) is lower than the above voltage sum (Vfa+Vfb), a large current may flow to the diode section 30 upon the application of a negative surge voltage, and damage the diode section 30.

Consequently, in the first or second example configuration of the input protection diode section 30, the forward voltage of the input protection diode section 30 is set to be higher than the voltage sum (Vfa+Vfb) of the forward voltage Vfa of the external diode DD and the forward voltage Vfb of the parasitic diode 12. This prevents the surge current INS from flowing to the input protection diode section 30 upon the application of a negative surge voltage to the input terminal TM1. As a result, no problem occurs. More specifically, the forward voltage of the input protection diode section 30 in a case where a forward current having a predetermined current value flows to the input protection diode section 30 is set to be higher than the voltage sum (Vfa+Vfb) of the forward voltage Vfa of the external diode DD and the forward voltage Vfb of the parasitic diode 12 in a case where the forward current having the predetermined current value flows to the external diode DD and the parasitic diode 12. In this instance, the predetermined current value may be, for example, the current value of the surge current INS that is presumably generated based on the negative surge voltage.

In the input protection diode section 30*a* depicted in FIG. 9A, the forward voltage of the input protection diode section 30 represents the forward voltage of the single input protection diode 31. In the input protection diode section 30*b* depicted in FIG. 9B, the forward voltage of the input protection diode section 30 represents the sum of forward voltages of the first to nth input protection diodes 31. When the input protection diode 31, the external diode DD, and the parasitic diode 12 have the same characteristics concerning the forward voltage, "n 3" should be applied to the input protection diode section 30*b* depicted in FIG. 9B.

Depending on the current carrying capacity (allowable forward current value) of the input protection diode section 30, the forward voltage of the input protection diode section 30 may be substantially equal to the above voltage sum (Vfa+Vfb). In such a case, when a negative surge voltage is applied to the input terminal TM1, the surge current INS partly flows through the input protection diode section 30. However, the input protection diode section 30 does not become damaged or otherwise defective as far as such a current is tolerable by the input protection diode section 30.

Figure 10:
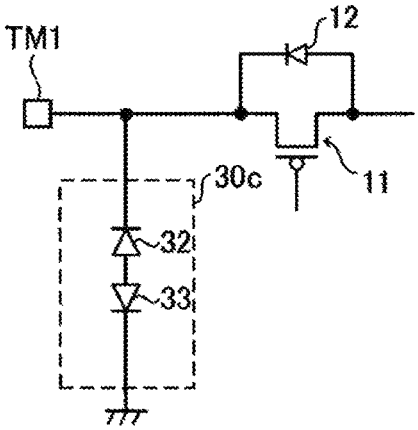
FIG. 10 is a diagram illustrating a third example configuration of the input protection diode section according to the example embodiment EX1_2 of the first embodiment of the present disclosure.

FIG. 10 illustrates an input protection diode section 30*c* representative of a third example configuration of the input protection diode section 30. The input protection diode section 30*c* includes input protection diodes 32 and 33. The anodes of these input protection diodes 32 and 33 are commonly connected to each other. The cathode of the input protection diode 32 is connected to the input terminal TM1, and the cathode of the input protection diode 33 is connected to the ground. Therefore, even if a negative voltage (−(Vfa+Vfb)) based on the negative surge current INS is applied to the input terminal TM1, no problem occurs because no current flows to the input protection diode section 30*c*.

[Example Embodiment EX1_3]

The example embodiment EX1_3 will now be described. An N-channel MOSFET may be used as the output transistor 11. In such a case, the source and drain of the N-channel MOSFET, which is used as the output transistor 11, are respectively connected to the output terminal TM2 and the input terminal TM1. In this case, too, it is true that the parasitic diode 12 having a forward direction from the output terminal TM2 to the input terminal TM1 is formed.

Example Embodiment EX1_4

The example embodiment EX1_4 will now be described. The diode 12 is formed in parallel to the output transistor 11. The diode 12 functions as a parallel diode having a forward direction from the output terminal TM2 to the input terminal TM1. The foregoing description assumes that the diode 12 acting as a parallel diode is a parasitic diode of the output transistor 11. However, the diode 12 acting as parallel diode may be a diode disposed separately from the output transistor 11 instead of being a parasitic diode of the output transistor 11. In such a case, for example, a bipolar transistor may be configured as the output transistor 11.

Second Embodiment

A second embodiment of the present disclosure will now be described. The second embodiment is implemented based on the first embodiment. As regards the matters not specifically described in conjunction with the second embodiment, the description given in conjunction with the first embodiment is applied to the second embodiment as well as long as there is no contradiction. If a description given in conjunction with the second embodiment is found contradictory to the corresponding description of the first embodiment during the interpretation of the description of the second embodiment, the description given in conjunction with the second embodiment may take precedence.

The second embodiment includes the following example embodiments EX2_1 and EX2_2. The example embodiments EX2_1 and EX2_2 may be implemented in combination.

Example Embodiment EX2_1

Figure 11:
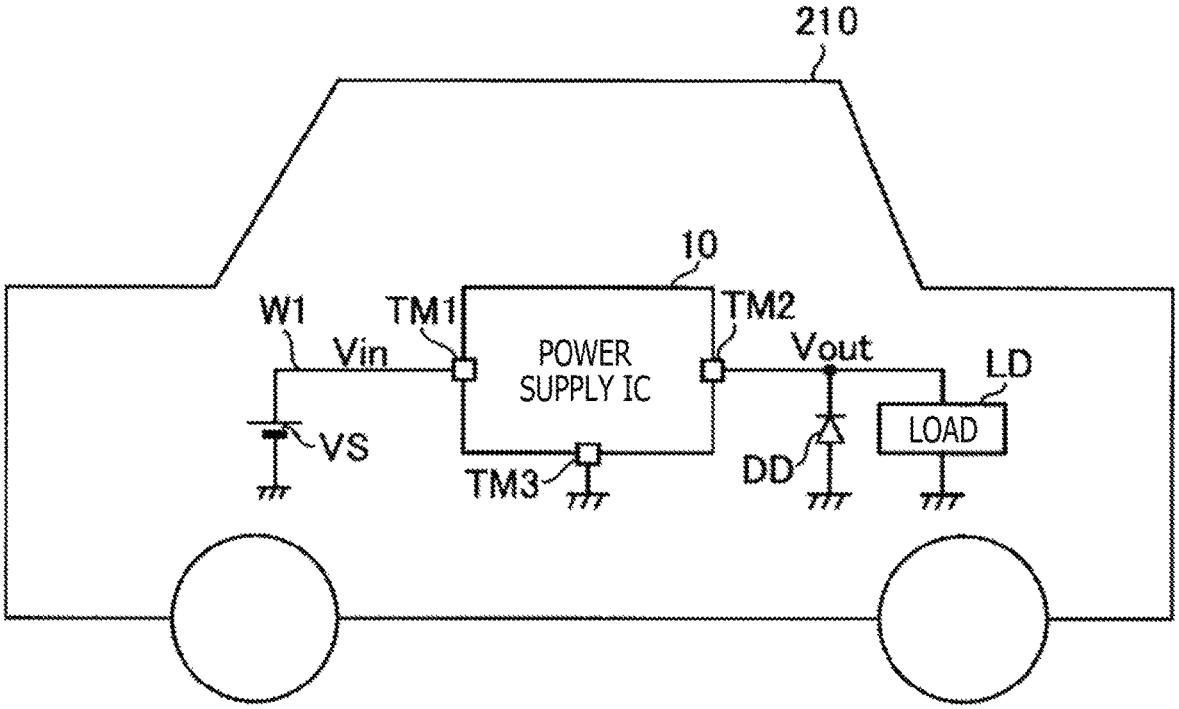
FIG. 11 is a diagram illustrating a schematic configuration of a vehicle according to a second embodiment of the present disclosure.

The example embodiment EX2_1 will now be described. The linear regulator according to the first embodiment may be mounted on any appropriate device. FIG. 11 illustrates a schematic configuration of a vehicle 210 that is an automobile in which the linear regulator according to the first embodiment is mounted. In the vehicle 210, the input voltage Vin is supplied from the voltage source VS, that is, a battery disposed in the vehicle 210, to the input terminal TM1 of the power supply IC 10. The power supply IC 10*a* depicted in FIG. 3 or the power supply IC 10*b* depicted in FIG. 6 is used as the power supply IC 10. As described above, the external diode DD is disposed between the ground and the output terminal TM2 of the power supply IC 10. The output voltage Vout from the output terminal TM2 of the power supply IC 10 is supplied to the load LD mounted in the vehicle 210.

In the vehicle 210, the load LD may be any electric device disposed in the vehicle 210. For example, the load LD may be an electronic control unit (ECU). The ECU provides, for example, cruise control of the vehicle 210 and drive control of an air conditioner, lamps, power windows, and airbags. The load LD may alternatively be, for example, the air conditioner, lamps, power windows, or airbags. The load LD may include a certain other power supply circuit.

Example Embodiment EX2_2

The example embodiment EX2_2 will now be described. The technology described in conjunction with the first embodiment may be applied to a switch IC. The switch IC is a semiconductor integrated circuit for switching an input-output terminal state between a conducting state and a non-conducting state. In the switch IC, the output transistor 11 is used as a switching element.

The switch IC can be formed by transforming the power supply IC 10 in the first embodiment in a manner described below. More specifically, the switch IC can be formed by deleting the voltage divider circuit, which includes the voltage-dividing resistors R1 and R2, from the power supply IC 10 (10*a*, 10*b*) in the first embodiment. Based on a switching signal supplied from the outside of the switch IC, the control circuit 13 in the switch IC switches the output transistor 11, which acts as the switching element, between an ON state and an OFF state. When the output transistor 11 in the switch IC is in the ON state, conduction occurs between the input terminal TM1 and the output terminal TM2 so that the input voltage Vin at the input terminal TM1 appears as the output voltage Vout at the output terminal TM2. Meanwhile, when the output transistor 11 is in the OFF state, the input terminal TM1 is disconnected from the output terminal TM2.

The external diode DD is connected to the output terminal TM2 of the switch IC, as is the case with the power supply IC 10 described in conjunction with the first embodiment. Further, the anode and cathode of the external diode DD are respectively connected to the ground and the output terminal TM2 of the switch IC. The switch IC may also include the output protection diode section 20 and input protection diode section 30 depicted in FIG. 6.

Moreover, the technology described in conjunction with the first embodiment may be applied to a semiconductor integrated circuit that includes the input terminal TM1, the output terminal TM2, and the output transistor 11 disposed between these terminals TM1 and TM2.

The embodiments of the present disclosure may be variously modified as needed within the scope of a technical idea defined by the appended claims. The foregoing embodiments are merely example embodiments of the present disclosure. It is to be understood that the significance of the present disclosure and the significance of terms describing individual component elements thereof are not limited in any way by those specifically described in the foregoing embodiments. Specific numerical values used in the foregoing description are merely illustrative and not restrictive, and may be changed to various other numerical values.

What is claimed is:

1. A linear regulator for generating an output voltage from an input voltage with reference to a ground potential, the linear regulator comprising:

a semiconductor integrated circuit; and an external diode that is externally connected to the semiconductor integrated circuit, wherein the semiconductor integrated circuit includes an input terminal to which the input voltage is applied, an output terminal to which the output voltage is applied, an output transistor that is disposed between the input terminal and the output terminal, a parallel diode that is formed in parallel to the output transistor, and has a forward direction from the output terminal to the input terminal, and a control circuit that controls the output transistor in accordance with a feedback voltage based on the output voltage, and an anode of the external diode is connected to a ground having the ground potential, and a cathode of the external diode is connected to the output terminal.

2. The linear regulator according to claim 1, wherein the semiconductor integrated circuit includes an output protection diode section that is disposed between the output terminal and the ground, the output protection diode section includes one or more output protection diodes having a forward direction from the ground to the output terminal, and a forward voltage of the output protection diode section is higher than a forward voltage of the external diode.

3. The linear regulator according to claim 1, wherein the semiconductor integrated circuit includes an output protection diode section that is disposed between the output terminal and the ground, the output protection diode section includes a first output protection diode and a second output protection diode, cathodes of the first and second output protection diodes are respectively connected to the output terminal and the ground, and anodes of the first and second output protection diodes are commonly connected to each other.

4. The linear regulator according to claim 1, wherein the semiconductor integrated circuit includes an input protection diode section that is disposed between the input terminal and the ground, the input protection diode section includes one or more input protection diodes having a forward direction from the ground to the input terminal, and a forward voltage of the input protection diode section is higher than a voltage sum of a forward voltage of the external diode and a forward voltage of the parallel diode.

5. The linear regulator according to claim 1, wherein the semiconductor integrated circuit includes an input protection diode section that is disposed between the input terminal and the ground, the input protection diode section includes a first input protection diode and a second input protection diode, cathodes of the first and second input protection diodes are respectively connected to the input terminal and the ground, and anodes of the first and second input protection diodes are commonly connected to each other.

6. The linear regulator according to claim 1, wherein the parallel diode is a parasitic diode formed on a metal-oxide-semiconductor field-effect transistor that acts as the output transistor.

7. The linear regulator according to claim 1, wherein when a negative surge voltage is applied to the input terminal, a current based on the negative surge voltage flows from the ground toward the input terminal through the external diode, the output terminal, and the parallel diode.

8. A semiconductor integrated circuit included in a linear regulator for generating an output voltage from an input voltage with reference to a ground potential, the semiconductor integrated circuit comprising:

an input terminal to which the input voltage is applied;

an output terminal to which the output voltage is applied and a cathode of an external diode disposed outside the semiconductor integrated circuit is to be connected;

an output transistor that is disposed between the input terminal and the output terminal;

a parallel diode that is formed in parallel to the output transistor, and has a forward direction from the output terminal to the input terminal; and a control circuit that controls the output transistor in accordance with a feedback voltage based on the output voltage, wherein an anode of the external diode is connected to a ground having the ground potential.

9. The semiconductor integrated circuit according to claim 8, further comprising:

an output protection diode section that is disposed between the output terminal and the ground, wherein the output protection diode section includes one or more output protection diodes having the forward direction from the ground to the output terminal, and a forward voltage of the output protection diode section is higher than a forward voltage of the external diode.

10. The semiconductor integrated circuit according to claim 8, further comprising:

an output protection diode section that is disposed between the output terminal and the ground, wherein the output protection diode section includes a first output protection diode and a second output protection diode, cathodes of the first and second output protection diodes are respectively connected to the output terminal and the ground, and anodes of the first and second output protection diodes are commonly connected to each other.

11. The semiconductor integrated circuit according to claim 8, further comprising:

an input protection diode section that is disposed between the input terminal and the ground, wherein the input protection diode section includes one or more input protection diodes having the forward direction from the ground to the input terminal, and a forward voltage of the input protection diode section is higher than a voltage sum of a forward voltage of the external diode and a forward voltage of the parallel diode.

12. The semiconductor integrated circuit according to claim 8, further comprising:

an input protection diode section that is disposed between the input terminal and the ground, wherein the input protection diode section includes a first input protection diode and a second input protection diode, cathodes of the first and second input protection diodes are respectively connected to the input terminal and the ground, and anodes of the first and second input protection diodes are commonly connected to each other.

13. The semiconductor integrated circuit according to claim 8, wherein the parallel diode is a parasitic diode formed on a metal-oxide-semiconductor field-effect transistor that acts as the output transistor.

14. The semiconductor integrated circuit according to claim 8, wherein when a negative surge voltage is applied to the input terminal, a current based on the negative surge voltage flows from the ground toward the input terminal through the external diode, the output terminal, and the parallel diode.

* * * * *